US005499688A

United States Patent [19]

Dennis

[11] Patent Number: 5,499,688

[45] Date of Patent: Mar. 19, 1996

[54] PDC INSERT FEATURING SIDE SPIRAL WEAR PADS

[75] Inventor: Mahlon D. Dennis, Kingwood, Tex.

[73] Assignee: Dennis Tool Company, Houston, Tex.

[21] Appl. No.: 324,253

[22] Filed: Oct. 17, 1994

Related U.S. Application Data

[63] Continuation-in-part of Ser. No. 108,071, Aug. 17, 1993, Pat. No. 5,379,854.

[51] Int. Cl.[6] ..... E21B 10/46; E21B 10/56; F16C 33/24

[52] U.S. Cl. ..... 175/426; 175/434; 175/427; 384/95; 384/907.1

[58] Field of Search ..... 175/426, 420.2, 175/434, 428, 432, 427; 51/307; 408/145; 384/95, 282, 566, 907.1

[56] References Cited

U.S. PATENT DOCUMENTS

| | | | |
|---|---|---|---|
| 4,255,165 | 3/1981 | Dennis et al. | 175/434 X |
| 4,339,009 | 7/1982 | Busby | 175/426 X |
| 4,592,433 | 6/1986 | Dennis | 175/428 |
| 4,604,106 | 8/1986 | Hall et al. | 175/434 X |
| 4,694,918 | 9/1987 | Hall . | |
| 4,729,603 | 3/1988 | Elfgen | 299/93 |
| 4,756,631 | 7/1988 | Jones | 175/359 X |
| 4,811,801 | 3/1989 | Salesky et al. . | |
| 5,205,684 | 4/1993 | Meskin et al. | 175/434 X |
| 5,217,081 | 6/1993 | Waldenstrom et al. | 175/420.2 |
| 5,248,006 | 9/1993 | Scott et al. | 175/432 X |
| 5,335,738 | 8/1994 | Waldenstrom et al. | 175/434 X |
| 5,351,770 | 10/1994 | Cawthorne et al. | 175/426 X |
| 5,370,717 | 12/1994 | Lloyd et al. | 51/293 |
| 5,379,853 | 1/1995 | Lockwood et al. | 175/428 |

*Primary Examiner*—Stephen J. Novosad
*Attorney, Agent, or Firm*—Gunn & Associates

[57] ABSTRACT

The present disclosure sets forth various forms of inserts for operating as elements in bearing drill bits and similar devices. A single insert is formed with an external side face of cylindrical construction. One or more strips of hardened materials such as diamond or other hard material are provided along the side face. At the end face, the insert incorporates exposed tungsten carbide, diamond or other hard material. A PDC layer is optionally placed over the end face. The PDC layer has the form of a covering terminating at a radius of curvature.

26 Claims, 1 Drawing Sheet

FIG.1
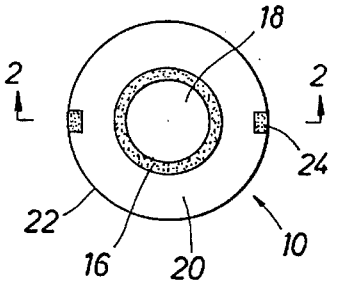
FIG.3
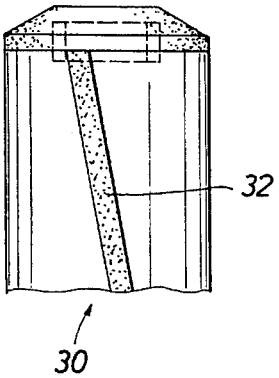
FIG.4
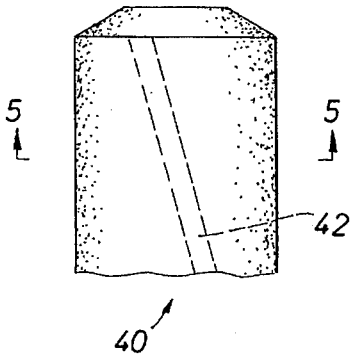
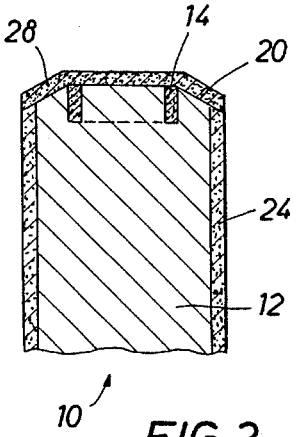
FIG.2
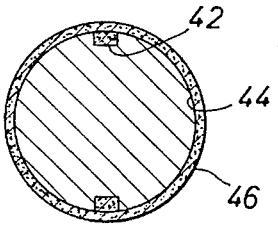
FIG.5
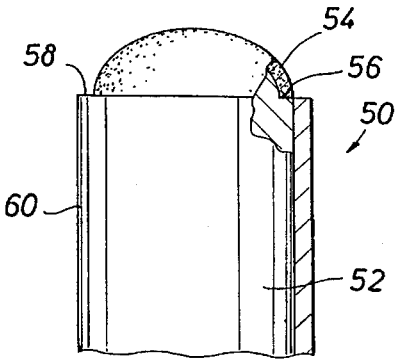
FIG.6
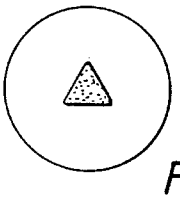
FIG.7
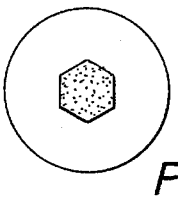
FIG.8
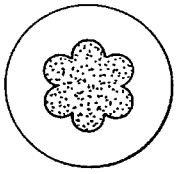
FIG.9
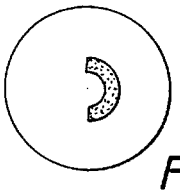
FIG.10
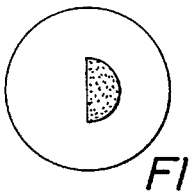
FIG.11

PDC INSERT FEATURING SIDE SPIRAL WEAR PADS

This application is a CIP of application Ser. No. 08/108,071 filed Aug. 17, 1993, now U.S. Pat. No. 5,379,854.

BACKGROUND OF THE DISCLOSURE

The present disclosure is directed to an insert for use in bearings drill bits, or other high wear applications and more particularly to an insert which is formed of hard metal and which is also provided with diamond or PDC hard surface material. PDC material is an industrial type diamond which is manufactured to a particular size and shape. It can be shaped so that it provides protection to the insert. The insert protected with the PDC cladding is able to last much longer. The insert is thus a composite made of a hard metal with the diamond or PDC which is cast to it or brazed in place. As will be understood, the two components which makeup such an insert do not easily go together. Rather, these are manufacturing processes which are somewhat difficult to carry out. This inevitably results from the fact that the finished product is an extremely hard composite insert which is very rugged and able to withstand tremendous levels of abrasion, shock and impact.

In drilling an oil well the drill bit is normally used to advance the well borehole by drilling into formations of rock of any degree of hardness that is encountered. In an extremely hard formation, the rate of wear on the drill bit is substantial. It is appropriate to protect the drill bit by incorporating very hard inserts. These serve as teeth in the fabricated drill bit. The fabricated drill bit incorporates these teeth for the express purpose of drilling through extremely hard materials. Such inserts are subject to extreme levels of wear compared to the remainder of the body of the drill bit, and for this reason, the drill bit is constructed with such inserts. In the fabrication of an individual insert, a body portion is normally formed of very hard metal. It is then clad with diamond or PDC material. This is attached by various bonding techniques, the most common being brazing. This approach in fabrication is highly desirable but it is difficult to execute in most instances. In one aspect of the present invention, a manufactured insert is set forth which is particularly able to withstand stress of usage for longer intervals than heretofore accomplished. The enhanced insert has much longer life. Partly, that results from the improved manufacturing process which will be described in some detail below.

Consider an insert which is exposed to wear on all sides of the insert. This typically occurs to inserts at certain locations on a rotary drill bit. The different sides of the insert are exposed at different points in the rotation of the drill bit to abrasive wear from hard formation materials. The present disclosure sets forth a cylindrical insert which is formed of hard metal and which has lengthwise strip of diamond or PDC material on the outer cylindrical face. In one embodiment, the strips extend lengthwise and parallel to the cylindrical shape of the insert body. In another embodiment, the lengthwise strips are set at an angle so that they form a part or an entire helical turn. The helical turn is provided with a sufficient lead angle that one or more helical inserts provides protection to the external face of the cylindrical insert.

In another aspect of the present invention, the upper end or exposed face at the tip of the insert is likewise protected. This tip is constructed with a crown or covering. The crown or covering comprises a diamond or PDC layer which is joined to the device. In particular, there is a problem in manufacturing so that the insert during fabrication serves as a support on which the crown is cast. In the region around the edge of the face where the cylindrical body starts, there is some difficulty in obtaining the proper shape during fabrication. The present disclosures assures that the diamond or PDC material fully covers the end face or crown of the device. This is accomplished by constructing the diamond or PDC body initially with a facing shoulder of substantial width. Moreover, the shoulder is formed of soft, readily machinable, sacrificial material in the fabrication process so that it can be machined away easily. The excessive material is removed after the insert has been fabricated and the diamond or PDC layer has been placed on the end face.

Advantages which flow from this type of construction will become more readily understood upon description of the preferred embodiments of the insert and the methods of manufacture. Moreover, it is assumed that the inserts will be used in a body forming a drill bit which can be used in the most difficult of drilling situations. The inserts may be used in other abusive wear applications such as mining pick tips, bearings, metal cutting tools, etc.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

FIG. 1 is a plan view of an insert in accordance with the teachings of the present disclosure which incorporates diamond or PDC material in a ring at the end face and an elongate straight member on the side of the cylinder of the insert;

FIG. 2 is a sectional view along the, line 2—2 of FIG. 1 showing details of construction of the insert and further incorporating an optional covering diamond or PDC layer over the end of the insert;

FIG. 3 is a side view of a cylindrical insert similar to FIG. 2 but differing in that the lengthwise diamond or PDC insert is positioned along a helical angle;

FIG. 4 is a view similar to FIGS. 2 and 3 showing another embodiment wherein a helical diamond or PDC insert is incorporated but it is located beneath the surface of an external layer of PDC around the insert;

FIG. 5 is a sectional view along the line 5—5 of FIG. 4 showing an insert formed of hardened metal and having a diamond or PDC rib extending along the cylindrical sidewall and further showing the cylindrical sidewall covered with a thin layer of PDC material;

FIG. 6 is a view of an alternate construction showing a diamond or PDC crown affixed to the end of a cylindrical insert body wherein the insert body is formed with a large shoulder and the outer portion of the shoulder is made of a softer material for easy machining and: removal; and FIG. 7–11 show alternate forms of hard material such as natural or synthetic diamond in the insert.

DETAILED DESCRIPTION OF THE PREFERRED EMBODIMENTS

Attention is now directed to FIG. 1 of the drawings where the numeral 10 identifies an insert in accordance with the present disclosure. The insert 10 is an elongate cylindrical member which serves as a tooth for an assembled or fabricated drill bit, and more particularly on a drill bit which has a body supporting one or more such inserts. The insert is elongate and cylindrical. At the illustrated end shown in FIG. 1 of the drawings, the insert is exposed for working against formations as the drill bit penetrates the earth. The opposite end terminates in a right cylindrical construction so that the opposite end can be attached to the drill bit body. The several modes of attachment are believed to be well known.

Considering FIGS. 1 and 2 jointly, the elongate cylindrical insert 10 incorporates a right cylindrical body 12 which is formed of hard metal. Indeed, it can be an alloy including a matrix of support material with a modest or a substantial portion of tungsten carbide (WC). The WC material has good characteristics for use in a drill bit construction. It is quite hard and is able to withstand substantial shock and abrasion. Nevertheless, its performance is enhanced by the incorporation of diamond or PDC material. PDC material refers to industrial or man made diamond material which can be formed to a requisite shape at the time of fabrication. The PDC material is especially useful to extend the life of the insert 10 because the PDC material provides enhanced wear and abrasion characteristics. The insert 10 is provided with a recessed, shallow groove which is filled with the diamond or PDC material at 14. This ring 14 presents an upper surface at a central location in the insert on the end face. The region 18 at the center is formed of the metal which makes up the insert body 12. There is a sloping chamfer 20 which extends to the outer edge of the cylindrical body. The face 20 is incorporated in the end face to avoid sharp corners. The chamfered region is especially beneficial in reducing down chipping and breaking of the insert should it be formed with a fight cylindrical construction. The angle between the faces 18 and 20 can be as little as about 5° and can be as much as about 50°. It is desirable that the angle be sufficient that corner chipping of an otherwise square end face is avoided. Avoidance of that risk is readily obtained by controlling the angle of the chamfer face multiple chamfer angles or forming a rounded corner shaped to a selected radius. It can be fabricated to this shape so that machining of the face 20 is ordinarily not required. In that sense, the insert at the time of fabrication is made as a cast member. This method of construction is believed to be well known.

The cylindrical body 12 has an outer cylindrical face 22 specifically illustrated in FIG. 1 of the drawings. The outer face may be contacted against the formations of the earth at any point on the exterior. This depends on the orientation of the insert supported in the drill bit. The outer cylindrical face is subject to wear and tear during use. This can be protected against by incorporation of a lengthwise parallel strip of diamond or PDC material 24. In the preferred embodiment, the strip 24 may be replicated at least two or more locations around the structure. Typically, between two and four such strips are found to be advantageous. The number can be any between one and eight. The strips included are relatively shallow and need only have a depth in the range of about 0.005 to 0.04 inches. The width can be up to about 0.080 inches or less. Generally, the benefits of the strips 24 are obtained even where they are relatively narrow. They do not cover a great portion of the external surface. Indeed, they need only cover perhaps five to fifteen percent of the external surface. Even at such a small portion of the external cylindrical surface, the surface 22 in contact with the formations is materially enhanced by the incorporation of the diamond or PDC strips 24. Considering FIGS. 1 and 2 jointly, it will be observed that the strips are formed at the time of fabrication. Through the use of an appropriate mold, the axial grooves can be formed at the time of casting the body 12. In any event, the strips 24 are preferably parallel, sometimes spaced evenly around the circumference, have a common depth and width, and are filled with similar material namely the diamond or PDC wear resistant material. In some instances, two or three strips are located in a close group or cluster. Assume that actual use involves wear in one quadrant; in that event, two or three strips in one quadrant will prevent excessive wear on the face in that quadrant.

The embodiment of FIG. 1 shows two such strips and they are relatively narrow in width. Alternate embodiments can include three or four strips. The number usually does not increase greatly beyond that.

Going now to FIG. 2, an optional overlay 28 is positioned on the end of the insert. This overlay can be formed over the faces 18 and 20. This is preferably included so that the entire end face has enhanced abrasion resistance. Moreover, it is formed with a curvature serving something as a cap or crown on the end of the insert wherein the outer edges are faired from the transverse, planar end face 18 into the sidewall 22. So to speak, the cap 28 terminates at an encircling radius of curvature, not a sharp edge. The radius of curvature preferably smoothly rounds the shape so that a sharp edge cannot be sensed on touch, and so that the surrounding edge of the end face of the insert smoothly engages formations of the earth and does not chip or break at the otherwise sharp corner. While the underlying structure may be chamfered, the exposed face in contact with formations of the earth is not chamfered. Rather, it is made with a radius of curvature which is commonly applied to the edges and corners.

Going now to FIG. 3 of the drawings, an alternate embodiment 30 is illustrated in side view and includes a lengthwise strip 32. The strip 32 is a spiral wear pad having a depth and width typical of the previously described strip 24 shown in another embodiment. Just as the strip 24 was formed of diamond or PDC material, this strip is also made of the same material and is located in a lengthwise groove. In this particular instance, the groove is formed at a helical angle. Again, typically, two to about four such diamond or PDC strips are incorporated and they all have a common helical angle. This enhances the likelihood that contact at any point of the periphery of the insert against abrasive rock formations will be supported on the PDC material, thereby reducing the rate of wear. Regular and irregular spacing is permitted.

Attention is now directed to FIG. 4 of the drawings where the numeral 40 identifies another embodiment. This embodiment includes a strip 42 which is placed in a helical groove as before. This strip however is buried somewhat under the surface. The surface of the insert has the form of a right cylinder as with the other versions. The external surface of the metal insert is identified at 44 in FIG. 5 of the drawings. There is however a very thin layer of diamond or PDC material 46 which is placed on the insert filling surrounding the tooth. It is not necessary that the cylindrical layer 46 extend the full length of the tooth; the bottom end of the insert need not be protected because that is the portion which is brazed, welded or otherwise joined to the drill bit body. In any event, the thin layer 46 typically measures about only 0.010 to about 0.040 inches in thickness and is a wear layer which is joined to the exterior.

Going now to FIG. 6 of the drawings, there is an embodiment 50 which incorporates a central body made of hard metal which has the form of a right cylinder and is identified by the numeral 52. A diamond or PDC layer 54 is placed over the dome shaped end face. Attachment of the diamond or PDC layer is enhanced by constructing the body 52 with a shoulder 56. The shoulder 56 is a receptacle on which the diamond or PDC material is attached. It serves as a fastening surface. The diamond or PDC material is formed in place on the body. It preferably is controlled in diameter so that it terminates at the shoulder 56. The shoulder 56 however is extended by an additional shoulder 58. The additional cylindrical component has the form of an integral layer 60. The layer 60 is a sacrificial layer which is removed by machining. The layer 60 is incorporated with the right cylindrical construction insert body at the time of fabrication of the body. The body is made of very hard metal typically including WC. The layer 60 is cast with it and is formed of softer material. It is sacrificial so it can be easily removed. As an example, the WC material that forms the cylindrical body is fabricated in a casting process with heat and pressure. The mold in which the casting occurs is preferably lined with the material 60. It is a softer metal. Typically, any type of metal which is relatively soft and yet which has an adequately high melting temperature will suffice. The layer 60 can be placed in the mold initially either by forming a cylindrical sleeve or insert, or by casting the layer 60 in a centrifugal casting procedure believed to be well known. In any event, the layer 60 defines the shoulder 58 which serves as an extension of the shoulder 56. The diamond or PDC material 54 is placed on the round shaped end face and is extended against the shoulder 56. After the end diamond or PDC crown 54 is formed, the next step in fabrication is to remove the soft metal layer 60. One technique is to remove the layer 60 by machining. It typically can be machined so that the removal process is carried out inexpensively and quickly. By contrast, machining of WC inserts is very slow because the material is so hard. Moreover, if a softer material is used, heat liberated during the machining process does not damage, destroy or otherwise harm the finished insert with the PDC crown over the end.

Going back to the lengthwise strips 24 shown in FIG. 1 and 32 shown in FIG. 3 such strips can be placed evenly around the circumference. In many instances this will suffice. Depending on the precise location on the exterior of the insert, the wear will be localized in one region or side of the cylindrical insert. Several modifications can be made to accommodate wear which is primarily on one side. Note therefore that the embodiment shown in FIG. 1 is intended for wear which is evenly distributed across the end face of the insert. In that embodiment, the ring 14 is preferably made of diamond or other materials. It is able to handle wear from directions which impinges on the end face. Likewise two or three strips along the side will suffice to provide protection.

Consider however the possibility that wear impinges on the insert 10 from a singular direction. In other words, the wear is distributed unevenly. In this particular aspect, FIGS. 10 and 11 show alternate forms of the insert construction where the diamond or other hard material is not arranged in the ring shown in FIG. 1. Rather, the hard material is arranged in a semi-circle as shown in FIGS. 10 and 11. Moreover, the strips along the length of the insert can be grouped on that side of the insert. Further and by contrast, if the wear is thought to be evenly distributed centrally the ring 16 shown in FIG. 1 can be modified by incorporation of the hard material inserted into FIGS. 7–9 inclusive. Therefore uneven wear arising from one side or the other is handled by the incorporation of the hard material which is inserted centrally as shown in FIGS. 7 to 11 and also by grouping one or more strips on the side exposed to maximum wear (see, for instance, FIG. 11).

The central inserts in FIGS. 7 to 11 are located in an insert of the sort shown in FIG. 3 which includes at least one of the wear pads spiraled along the outer cylindrical wall of the cylindrical insert. The insert is thus protected against excessive wear by the spiral strip, one or more, while the end face can be the central ring of FIG. 1 or the hard material of FIGS. 7 to 11. The spiral strips, one or more, are typically fabricated in place or can be brazed in manufacturing. The unfinished insert can be assembled by applying other manufacturing processes.

While the foregoing is directed to the preferred embodiments, the scope of the present disclosure is set forth by the claims which follow.

I claim:

1. A wear resistant insert to be fastened in a drill bit wherein the insert is exposed to abrasion and shock loading during use and is subject to wear as a result of use, the insert comprising:

(a) an elongate cylindrical body formed of hard metal and having diamond like material therein wherein said body comprises a portion of a right cylinder with an end face and a cylindrical side face;

(b) a spiraled strip of wear material extending along the side face and into said body so that said body has an exposed face of wear material; and (c) a wear material layer over said end face wherein said material forms an end face covering and has a radius of curvature to thereby avoid a sharp edge.

2. The apparatus of claim 1 wherein said body has at least two of said spiral strips of wear material spaced around said body and spiralling along said body.

3. The apparatus of claim 1 wherein said body includes at least two of said spiral strips and an end face of wear material.

4. The apparatus of claim 1 wherein said spiral strip is diamond like material.

5. The insert of claim 1 wherein said end face material layer thereon defines a recessed ring.

6. The apparatus of claim 1 wherein said insert end face includes a central circular area.

7. The apparatus of claim 1 wherein said end face includes an integrally formed insert in said end face of diamond like material.

8. A wear resistant bearing to be exposed to abrasion and shock loading during use and which is subject to wear as a result of use, the bearing comprising:

(a) a cylindrical body formed of hard metal and having an end face of circular configuration and a side face along said cylindrical body;

(b) at least one spiraled wear material strip extending along the side face and extending into the body so that the strip has an exposed face; and (c) wherein said strip of wear material is formed of a diamond like material and is crystalline in nature and provides wear resistance on the side face of said body.

9. The apparatus of claim 8 wherein said end face is covered by a bonded layer of diamond like material thereon.

10. The apparatus of claim 8 wherein said cylindrical body has a central reinforcing member bonded therein extending to a specified depth and having a controlled geometric cross section.

11. The apparatus of claim 10 wherein said cross section is circular.

12. The apparatus of claim 10 wherein said cross section is a three sided geometric figure.

13. The apparatus of claim 10 wherein said cross section is a geometric figure with at least four sides.

14. A wear resistant insert for a drill bit comprising:

(a) an elongate cylindrical body having an end face and a cylindrical side face;

(b) a spiraled strip of wear material extending along said face and embedded in said cylindrical body wherein said wear material is harder than said body; and (c) an end face covering bonded to said body and formed of harder material than said body:

15. The apparatus of claim 14 wherein said end face is covered by a bonded layer of diamond like material thereon.

16. The apparatus of claim 14 wherein said body has at least two of said spiral strips of wear material spaced around said body and spiralling along said body.

17. The apparatus of claim 14 wherein said body includes at least two of said spiral strips and an end face of wear material.

18. The apparatus of claim 14 wherein said spiral strip is diamond like material.

19. The apparatus of claim 14 wherein said end face includes an integrally formed insert in said end face of diamond like material.

20. The apparatus of claim 14 wherein said cylindrical body has a central reinforcing member bonded therein extending to a specified depth and having a controlled geometric cross section.

21. The apparatus of claim 14 wherein said cylindrical body has a central reinforcing member bonded therein extending to a specified depth and having a controlled geometric cross section.

22. The apparatus of claim 21 wherein said cross section is circular.

23. The apparatus of claim 21 wherein said cross section is a three sided geometric figure.

24. The apparatus of claim 21 wherein said cross section is a geometric figure with at least four sides.

25. The apparatus of claim 14 wherein said end face is frustoconical in shape.

26. The apparatus of claim 14 wherein said end face is conic in shape.

* * * * *